US007260514B2

(12) United States Patent
Huang

(10) Patent No.: US 7,260,514 B2
(45) Date of Patent: Aug. 21, 2007

(54) BENDING MOMENT

(75) Inventor: Sujian J. Huang, Beijing (CN)

(73) Assignee: Smith International, Inc., Houston, TX (US)

( * ) Notice: Subject to any disclaimer, the term of this patent is extended or adjusted under 35 U.S.C. 154(b) by 136 days.

(21) Appl. No.: 11/009,954

(22) Filed: Dec. 10, 2004

(65) Prior Publication Data

US 2005/0165589 A1 Jul. 28, 2005

Related U.S. Application Data

(63) Continuation of application No. 09/635,116, filed on Aug. 9, 2000, now Pat. No. 6,873,947, which is a continuation of application No. 09/524,088, filed on Mar. 13, 2000, now Pat. No. 6,516,293.

(51) Int. Cl.
*G06F 17/10* (2006.01)
*G06G 7/48* (2006.01)

(52) U.S. Cl. ..... 703/2; 703/7; 175/57

(58) Field of Classification Search ..... 175/24, 175/61, 374, 57; 703/7, 10, 2; 702/9
See application file for complete search history.

(56) References Cited

U.S. PATENT DOCUMENTS 4,187,922 A * 2/1980 Phelps ..... 175/374
4,408,671 A 10/1983 Munson
4,815,342 A 3/1989 Brett et al.
5,213,168 A * 5/1993 Warren et al. ..... 175/61
5,787,022 A 7/1998 Tibbitts et al.
5,864,058 A 1/1999 Chen
5,868,213 A 2/1999 Cisneros et al.
5,950,747 A 9/1999 Tibbitts et al.
6,021,377 A 2/2000 Dubinsky et al.
6,095,262 A 8/2000 Chen
6,213,225 B1 4/2001 Chen
6,241,034 B1 6/2001 Steinke et al.
6,276,465 B1 * 8/2001 Cooley et al. ..... 175/24
6,290,006 B1 9/2001 Crawford
6,349,595 B1 2/2002 Civolani et al.

(Continued)

FOREIGN PATENT DOCUMENTS

SU 933932 6/1982

(Continued)

OTHER PUBLICATIONS

Certification and Notarization dated Nov. 12, 2003 from Universe Technical Translation.

(Continued)

*Primary Examiner*—Russell Frejd
(74) *Attorney, Agent, or Firm*—Osha Liang LLP

(57) ABSTRACT

A method for designing a roller cone drill bit comprising selecting bit design parameters, selecting parameters of an earth formation, selecting drilling parameters, simulating drilling a selected earth formation, determining force on at one of a cutting element, a cone, and a drill bit, determining a location of the force, calculating bending moment, and varying at least one of the bit design parameters and repeating the simulating and the calculating until the bending moment meets a selected criterion. The method further comprising converting said bending moment into a visual representation.

18 Claims, 7 Drawing Sheets

U.S. PATENT DOCUMENTS

| | | | |
|---|---|---|---|
| 6,401,839 | B1 | 6/2002 | Chen |
| 6,412,577 | B1 | 7/2002 | Chen |
| 6,516,293 | B1 | 2/2003 | Huang et al. |

FOREIGN PATENT DOCUMENTS

| | | | |
|---|---|---|---|
| SU | 1461855 | A1 | 2/1989 |
| SU | 1654515 | A1 | 7/1991 |
| SU | 1691497 | A1 | 11/1991 |
| WO | WO-00/12859 | | 3/2000 |
| WO | WO-00/12860 | | 3/2000 |

OTHER PUBLICATIONS

Translation of Description of Invention No. 933932 dated Jun. 7, 1982 (2 pages).

D. Ma, et al. "Dynamics of Roller Cone Bits", Journal of Energy Resources Technology, Dec. 1985, vol. 107 (pp. 543-548).

D. Ma, et al. "A New Way to Characterize the Gouging-Scraping Action of Roller Cone Bits", Society of Petroleum Engineers, 1989 (24 pgs.).

Boris L. Steklianov, "Increasing the Efficiency of Rock-Cutting Tools on the Basis of Comparative Analysis of the Kinetic Characteristics of Their Cutting Structure"; NDERI, 1990 (24 pages).

Robert L. McIntyre, "Surface Mine Rotary Drilling", Smith-Gruner (3 pages).

RockBit International, "System Designed to Speed Continuous Coring Operation", (4 pages).

RockBit International, "If You've Ever Doubted RBI's Ability to Drill at a Lower Cost Per Foot . . . Ask the Folks Drilling This Well", (4 pages).

RockBit International, "The Leader in High-Speed Drill Bit Technology" (24 pages).

Sandvik Rock Bits, "Sandvik in the World of Oil and Gas" (8 pages).

B. L. Steklyanov, et al.; "Improving the Effectiveness of Drilling Tools", KhM-3 Oil Industry Machine Building; (1991) pp. 1-35.

Dekun Ma, et al.; "The Computer Simulation of the Interaction Between Roller Bit and Rock"; International Meeting on Petroleum Engineering; PR China; Nov. 14-17, 1995; pp. 309-317.

Ma Dekun, et al., "The Operational Mechanics of The Rock Bit", Petroleum Industry Press, 1996, pp. 1-243.

Society of Petroleum Engineers Paper No. 56439, "Field Investigation of the Effects of Stick-Slip, Lateral, and Whirl Vibrations on Roller Cone Bit Performance", S.L. Chen, et al., presented Oct. 3-6, 1999, (10 pages).

Society of Petroleum Engineers Paper No. 71053, "Development and Application of a New Roller Cone Bit with Optimized Tooth Orientation", S. L. Chen, et al., presented May 21-23, 2001 (15 pages).

Society of Petroleum Engineers Paper No. 71393, "Development and Field Applications of Roller Cone Bits with Balanced Cutting Structure", S. L. Chen, et al., presented Sep. 30-Oct. 3, 2001 (11 pages).

Hancke, et al., G.P. A Control System for Optimizing Deep Hole Drilling Conditions, IECON 1991 International Conference on Industrial Electronics, Control and Instrumentation, 1991, pp. 2279-2284.

Ertunc, et al., H. M. Real Time Monitoring of Tool Wear Using Multiple Modeling Method, IEEE International Electric Machines and Drives Conference, IEMDC 2001, pp. 687-691.

Hancke, G. P. The Effective Control of a Deep Hole Diamond Drill, Conference Record of the IEEE Industry Applications Society Annual Meeting, 1991, pp. 1200-1205.

Howie, et al., W. L. A Smart Bolter for Improving Entry Stability, Conference Record of the IEEE Industry Applications Society Annual Meeting, 1989, pp. 1556-1564.

Translation of Description of Invention No. 295857 dated Feb. 12, 1971 (2 pages).

Translation of Description of Invention No. 398733 dated Sep. 27, 1973 (2 pages).

Translation of Description of Invention No. 420749 dated Mar. 25, 1974 (2 pages).

Translation of Description of Invention No. 229371 dated Oct. 23, 1968 (1 page).

Translation of Description of Invention No. 436147 dated Jul. 15, 1974 (2 pages).

Translation of Description of Invention No. 469801 dated May 5, 1975 (2 pages).

Translation of Description of Invention No. 515867 dated May 30, 1976 (2 pages).

Palashchenko, et al.; "Study of Roller Cone Bits With Disk Rink Inserts"; Neftyanoye Khozyaystvo (Oil Industry), Issue 11, 1987 (4 pages).

Rudolf C.O. Pessier, et al. "Rolling Cone Bits With Novel Gauge Cutting Structure" Drill Faster, More Efficiently, SPE 30473; 1995.

M. C. Sheppard, et al. "The Forces at the Teeth of a Drilling Rollercone bit: Theory and Experiment", SPE 18042; 1988 (pp. 253-260).

"Longer Useful Lives for Roller Bits Cuts Sharply Into Drilling Costs" S.A. Mining & Engineering Journal, Mar. 1979, (pp. 39-43).

Johannes D. Brakel, "Prediction of Wellbore Trajectory Considering Bottom Hole Assembly and Drill Bit Dynamics", The University of Tulsa, (66 pages).

R. K. Dropek, et al. "A Study to Determine Roller Cone Cutter Offset Effects at Various Drilling Depths", ASME vol. 78-Pet-23, (10 pages).

Doodnath Ramsunder "Bit Deviation Forces Due to Rock-Bit Interaction" University of Tulsa, (66 pages).

E. I. Umez-Eronini, "Rotary Drill Bit/Rock Model with Cutter Offset" Journal of Energy Resources Technology, vol. 105, Sep. 1983 (3 pages).

D. Ma, et al. "Kinematics of the Cone Bit" SPE 10563; Jun. 1985 (30 pages).

* cited by examiner

| CONE | ROW | MOMENT_MAX (klbs-in) | MOMENT_MEDIAN (klbs-in) | MOMENT_AVER (klbs-in) | COUNTS | ANGLE |
|---|---|---|---|---|---|---|
| 1 | | 46.964 | 14.960 | 14.860 | | |
| 1 | 1 | 0.000 | 0.000 | 0.000 | 16 | 0.00 |
| 1 | 2 | 0.890 | 0.067 | 0.124 | 16 | 0.00 |
| 1 | 3 | 14.521 | 4.558 | 4.372 | 14 | 0.00 |
| 1 | 4 | 40.656 | 10.283 | 9.824 | 8 | 0.00 |
| 1 | 5 | 21.869 | 4.804 | 5.773 | 1 | 0.00 |
| 2 | | 47.101 | 15.032 | 16.889 | | |
| 2 | 1 | 0.000 | 0.000 | 0.000 | 13 | 0.00 |
| 2 | 2 | 0.768 | 0.056 | 0.113 | 13 | 0.00 |
| 2 | 3 | 7.414 | 2.330 | 2.253 | 13 | 0.00 |
| 2 | 4 | 29.046 | 9.839 | 9.081 | 11 | 0.00 |
| 2 | 5 | 33.479 | 9.848 | 10.188 | 3 | 0.00 |
| 3 | | 78.961 | 14.272 | 16.578 | | |
| 3 | 1 | 0.000 | 0.000 | 0.000 | 11 | 0.00 |
| 3 | 2 | 0.690 | 0.036 | 0.100 | 11 | 0.00 |
| 3 | 3 | 5.055 | 0.938 | 1.035 | 11 | 0.00 |
| 3 | 4 | 18.696 | 7.159 | 6.827 | 13 | 0.00 |
| 3 | 5 | 77.351 | 11.209 | 12.524 | 5 | 0.00 |
| 3 | 6 | 23.185 | 3.621 | 4.862 | 1 | 0.00 |

*FIG. 5*

BENDING MOMENT

CROSS-REFERENCE TO RELATED APPLICATIONS

This application is a continuation-in-part of U.S. patent application Ser. No. 09/635,116 ("the '116 application"), now U.S. Pat. No. 6,873,947, which was filed on Aug. 9, 2000 as a continuation of U.S. Pat. No. 6,516,293 ("the '293 patent"), filed on Mar. 13, 2000. This application claims benefit, pursuant to 35 U.S.C. §120, from both the '116 application and the '293 patent. The disclosures of the '116 application and the '293 patent are expressly incorporated by reference in their entireties.

BACKGROUND OF INVENTION

Background Art

Roller cone rock bits and fixed cutter bits are commonly used in the oil and gas industry for drilling wells. FIG. 1 shows one example of a conventional drilling system drilling an earth formation. The drilling system includes a drilling rig 10 used to turn a drill string 12, which extends downward into a well bore 14. Connected to the end of the drill string 12 is roller cone-type drill bit 20, shown in further detail in FIG. 2.

As shown in FIG. 2, a roller cone bit 20 typically comprises a bit body 22 having an externally threaded connection at one end 24, and a plurality of roller cones 26 (usually three as shown) attached to the other end of the bit body 22 and able to rotate with respect to the bit body 22. Attached to the roller cones 26 of the bit 20 are a plurality of cutting elements 28, typically arranged in rows about the surface of the roller cones 26. The cutting elements 28 can be tungsten carbide inserts, polycrystalline diamond compacts, or milled steel teeth. If the cutting elements 28 are milled steel teeth, they may be coated with a hardfacing material.

The bit body includes one or more legs, each having thereon a bearing journal. The most commonly used types of roller cone drill bits each include three such legs and bearing journals. A roller cone is rotatably mounted to each bearing journal. During drilling, the roller cones rotate about the respective journals while the bit is rotated. The roller cones include a number of cutting elements, which may be press fit inserts made of tungsten carbide and other materials, or may be milled steel teeth.

The cutting elements engage the formation in a combination of crushing, gouging, and scraping or shearing actions which remove small segments of the formation being drilled. The inserts on a cone of a three-cone bit are generally classified as inner-row inserts and gage-row inserts. Inner-row inserts engage the bore hole bottom, but not the well bore wall. Gage-row inserts engage the well bore wall and sometimes a small outer ring portion of the bore hole bottom. The direction of motion of inserts engaging the rock on a two or three-cone bit is generally in one direction or within a very small range of directions, i.e., within a range of 10 degrees or less.

When a roller cone bit is used to drill earth formations, the bit experiences strong forces acting on different locations on the bit. These forces result in bending moments that may potentially deform the drill bit or may even cause leg breakage. The intensity of the bending moment depends upon, among other factors, the hardness of the earth formation, the magnitude of the force acting on the bit, the location of the force, and the geometry of the cutting elements.

Drill bit life and efficiency are of great importance because drilling operations are very expensive. The rate of penetration of the bit through earth formations (i.e., drill bit efficiency) is related to the weight on bit, rotational speed of the bit, and drill bit characteristics. Bending moments may increase wear and fatigue on the drill bit, leading to premature failure of the bit. Excessive bending moments may also lead to leg breakage of the drill bit, which would require further expense in fishing operations to remove the broken leg from the borehole.

For the foregoing reasons, there exists a need for an effective method to design a drill bit by taking into account bending moments on a bit. What is needed are methods to analyze and optimize the bending moments on roller cone bits drilling earth formations.

SUMMARY OF INVENTION

In one aspect, the invention provides a method for design a drill bit. The method comprises selecting bit parameters, selecting parameters of an earth formation, and selecting drilling parameters. The method further comprises simulating drilling the earth formation, calculating a bending moment action on the drill bit, and varying at least one of the bit design parameters and repeating the simulating and the calculating until the bending moment meets a selected criterion. The method further comprises determining force acting on at least one of a cutting element, a cone, and a drill bit, and determining location of the force.

In another aspect, the invention provides a method further comprising determining the amplitudes of the bending moments. The method further comprises limiting the amplitude of the bending moments.

In another aspect, the invention provides a method further comprising determining the frequency of bending moments. The method further comprises limiting the frequency of bending moments. The method further comprises determining and limiting the frequency of a selected bending moment amplitude.

In another aspect, the invention provides a method for designing a drill bit further comprising converting bending moment into a visual representation.

In another aspect, the invention provides a drill bit designed by the method the method of selecting bit parameters, selecting parameters of an earth formation, and selecting drilling parameters. The method further comprises simulating drilling the earth formation, calculating a bending moment action on the drill bit, and varying at least one of the bit design parameters and repeating the simulating and the calculating until the bending moment meets a selected criterion. The method further comprises determining force acting on at least one of a cutting element, a cone, and a drill bit, and determining location of the force.

Other aspects and advantages of the invention will be apparent from the following description and the appended claims.

BRIEF DESCRIPTION OF DRAWINGS

FIG. 5 shows an output of an embodiment of the invention in tabular form.

DETAILED DESCRIPTION

In one aspect, embodiments of the present invention relate to methods of simulating bending moments of a roller cone bit. Simulation of forces acting on roller cone bits would enable analyzing the effects of bending moments on proposed bit designs and permit studying the effect of bending moments on the drilling characteristics of a bit. Such analysis and study would enable the optimization of roller cone drill bit designs to produce bits which exhibit desirable drilling characteristics and longevity. Similarly, the ability to simulate roller cone bit performance would enable studying the effects of altering the drilling parameters on the drilling performance of a given bit design. Such analysis would enable the optimization of drilling parameters for purposes of maximizing the drilling performance of a given bit.

In another aspect, embodiments of the invention relate to drill bits having optimized bending moment characteristics. In order to account for the effects of bending moments on drill bit performance, it is desirable to be able to analyze the bending moment in a drilling operation. After a detailed analysis, bit design parameters may be modified to minimize or compensate for bending moment. Therefore, a model of the bending moment has been designed and is described in detail below.

Significant expense is involved in the design and manufacture of drill bits. Therefore, having accurate models for simulating and analyzing the drilling characteristics of bits can greatly reduce the cost associated with manufacturing drill bits for testing and analysis purposes. For this reason, several models have been developed and employed for the analysis and design of 2, 3, and 4 roller cone bits. See, for example, U.S. Pat. Nos. 6,213,225, 6,095,262, 6,412,577, and 6,401,839. In addition, U.S. Pat. No. 6,516,293 ("the '293 patent") discloses a simulation method for multiple cone bits, which is assigned to the assignee of the instant application and is incorporated by reference in its entirety.

The simulation model disclosed in the '293 patent is particularly useful in that it provides a means for analyzing the forces acting on individual cutting elements on the bit, thereby allowing for the design of, for example, faster drilling bits or the design of bits having optimal spacing and placing of cutting elements thereon. By analyzing forces and resulting moments acting on the individual cutting elements of a bit prior to making the bit, it is possible to avoid expensive trial and error in designing effective and long-lasting bits. Additionally, analyzing the bending moments induced on a drill bit and designing a bit in view of induced bending moments may prevent deformation of the bit and leg breakage.

Figure 1:
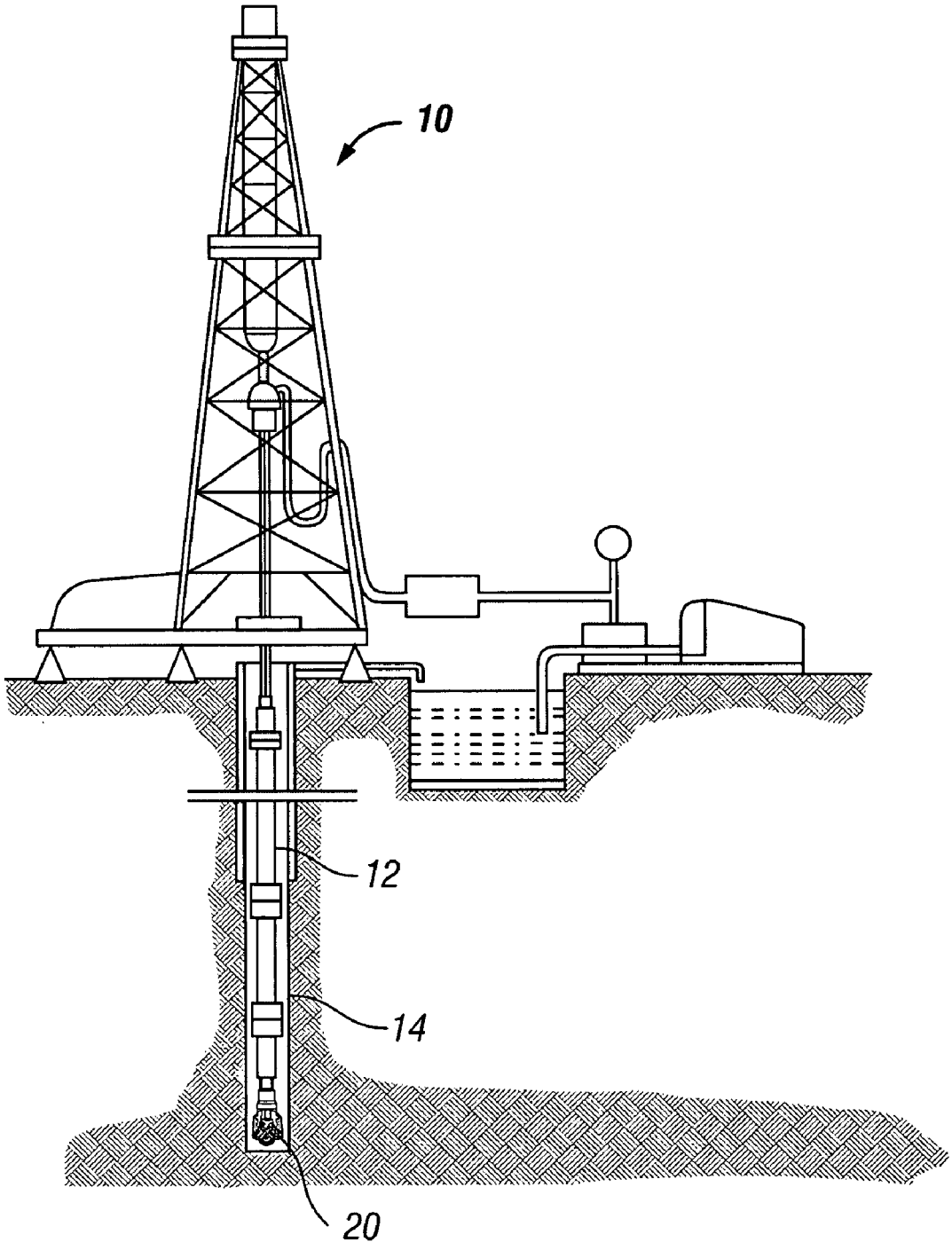
FIG. 1 (Prior Art)
FIG. 1 shows a schematic diagram of a conventional drilling system for drilling earth formations having a drill string attached at one end to a roller cone drill bit.
Figure 2:
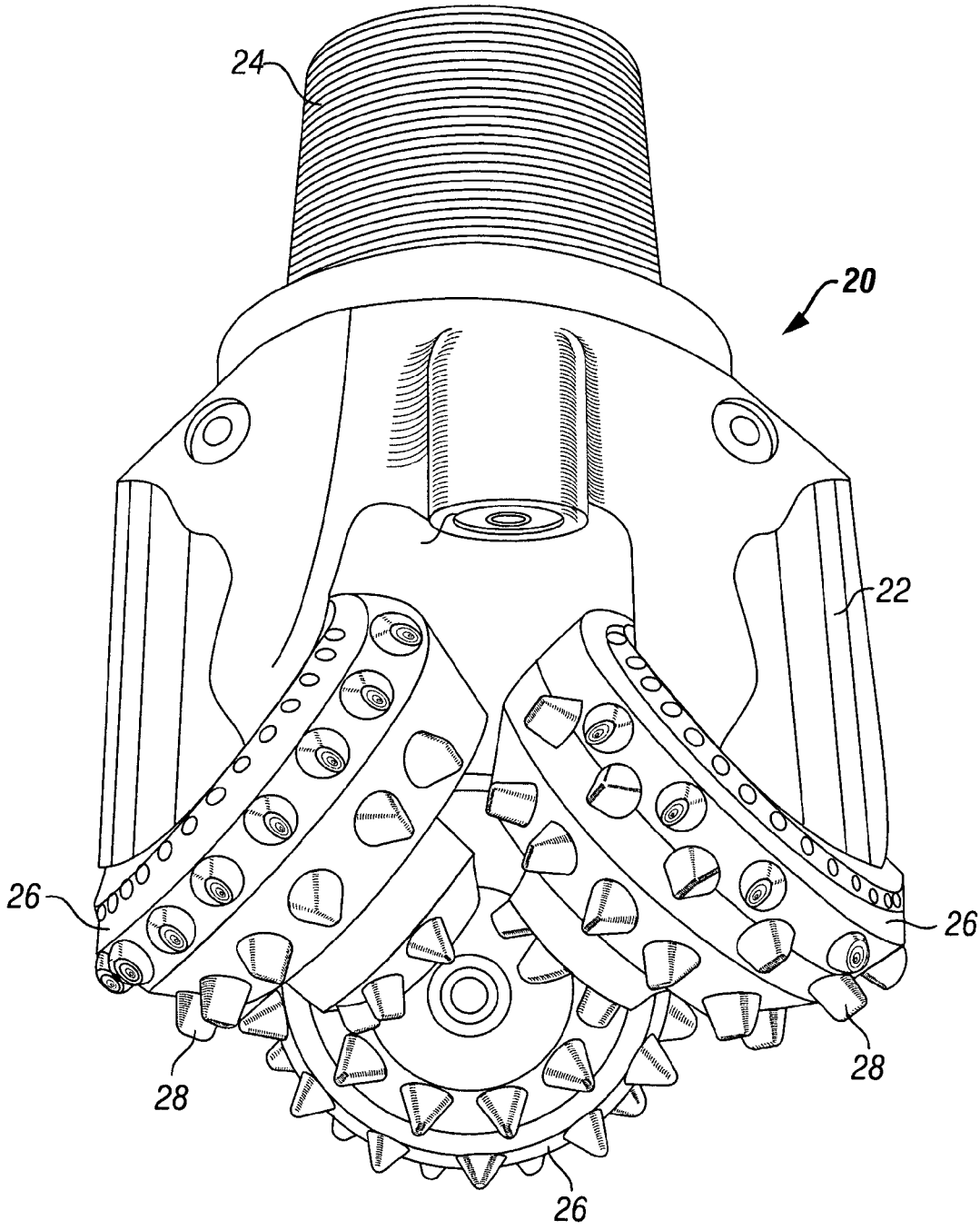
FIG. 2 (Prior Art)
FIG. 2 shows a perspective view of a conventional roller cone drill bit.
Figure 3A:
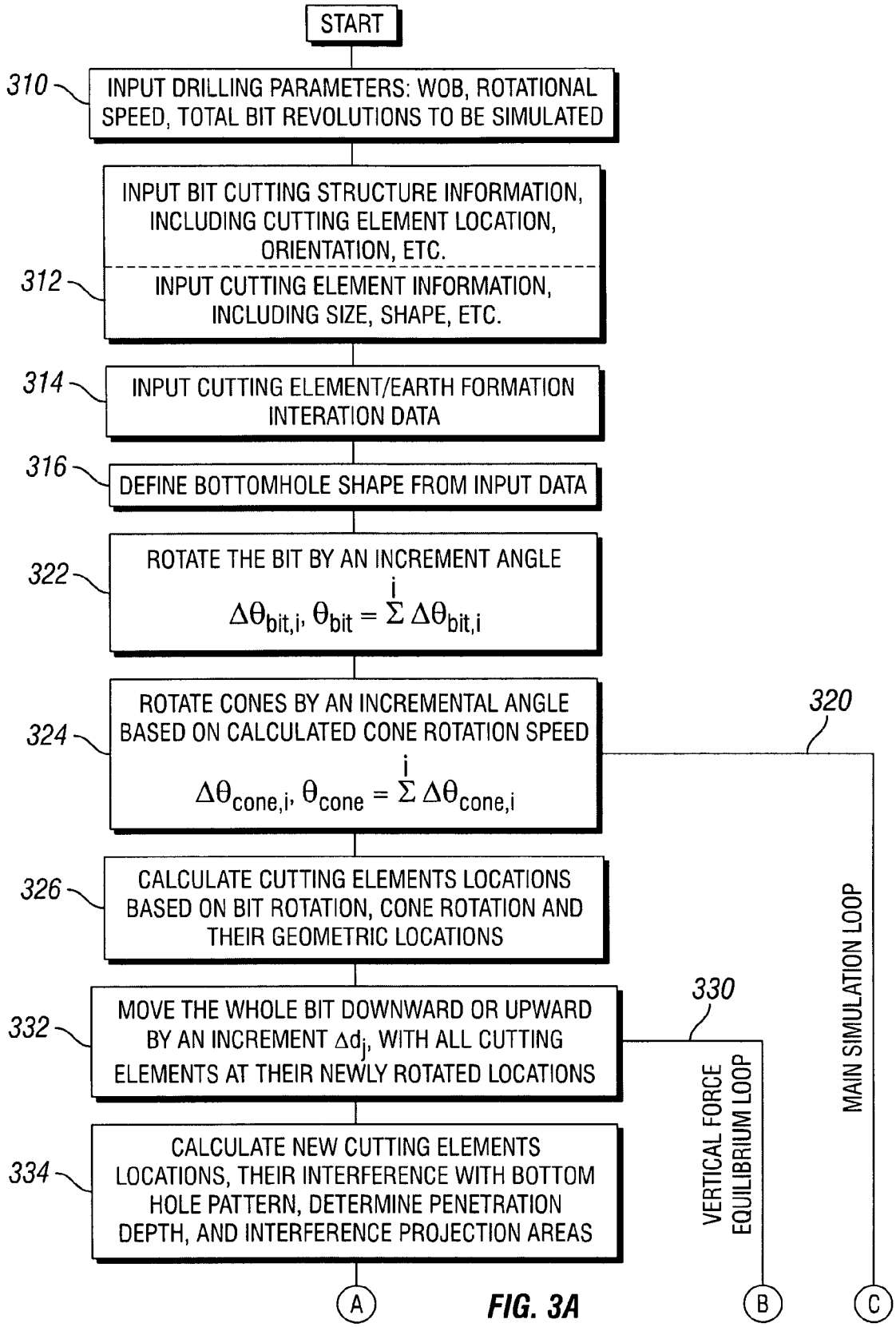
FIG. 3A and FIG. 3B show a flowchart of an embodiment of the invention for generating a visual representation of a roller cone bit drilling earth formations.
Figure 3B:
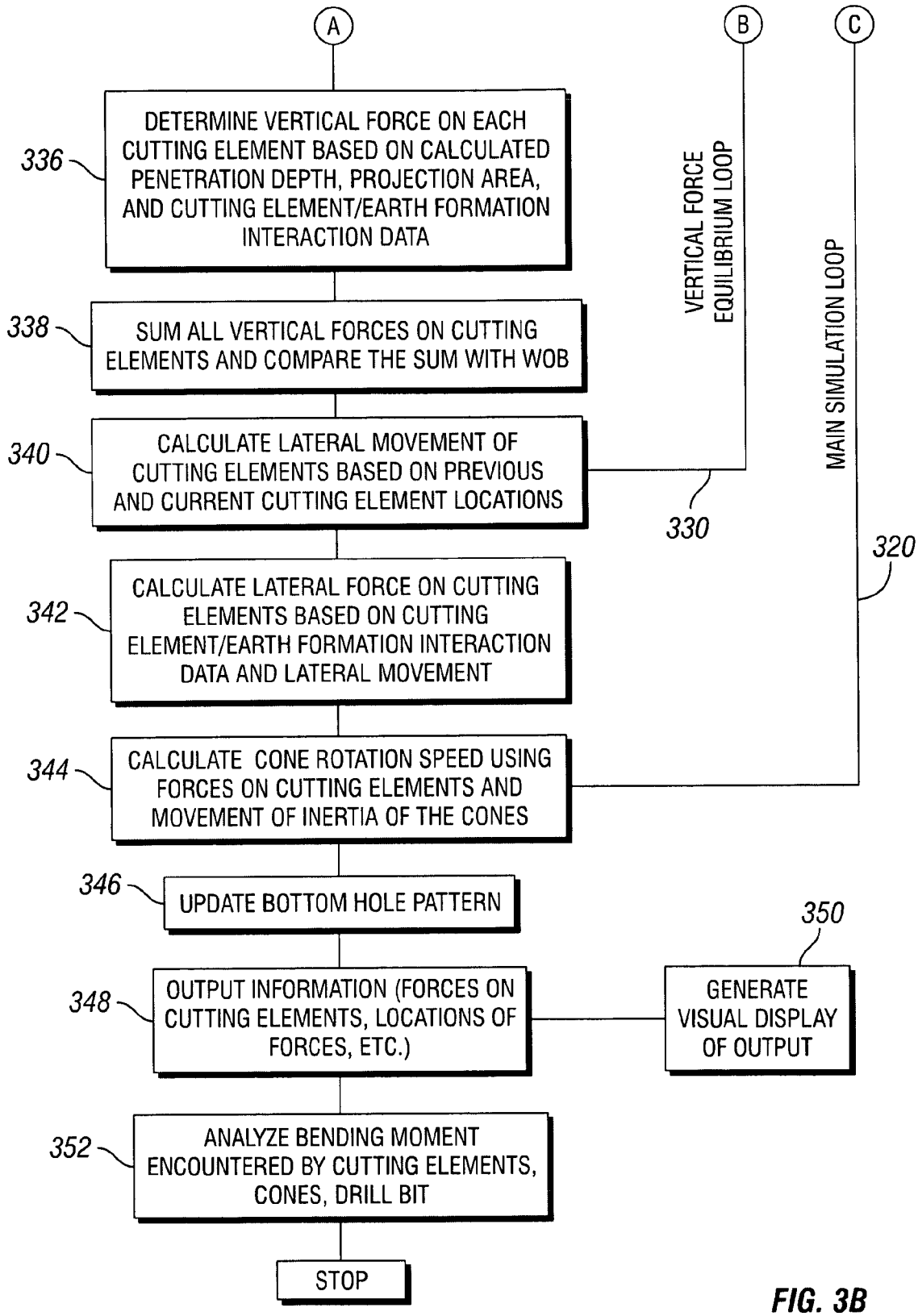

FIGS. 3A and 3B show a flow chart of one embodiment of the invention for simulating a roller cone drill bit drilling a selected earth formation. The parameters used in the simulation may include drilling parameters 310, bit design parameters 312, cutting element/earth formation interaction data 314, and bottomhole geometry data 316. In addition, an initial bit speed/cone speed rotation ratio may be included. Typically, the bottomhole geometry prior to drilling simulation will be a planar surface, but this is not a limitation on embodiments of the invention. The input data 310, 312, 314, 316 may be stored in an input library and later retrieved as needed during simulation calculations.

Drilling parameters 310 that may be used include the axial force applied on the drill bit (commonly referred to as the weight on bit, "WOB") and the rotational speed of the drill bit (typically provided in revolutions per minute, "RPM"). It should be understood that drilling parameters are not limited to these variables, but may include other variables, such as, rotary torque and mud flow volume. Additionally, drilling parameters 310 provided as input may include the total number of bit revolutions to be simulated, as shown in FIG. 3A. However, it should be understood that the total number of revolutions is provided simply as an end condition to signal the stopping point of simulation and is not necessary for the calculations required to simulate or visually represent the drilling operation. Alternatively, another end condition may be employed to determine the termination point of simulation, such as the total drilling depth (axial span) to be simulated or any other final simulation condition. Alternatively, the termination of simulation may be accomplished by operator command, or by performing any other specified operation.

Bit design parameters 312 used as input may include bit cutting structure information, such as the cutting element location and orientation on the roller cones, and cutting element information, such as cutting element size(s) and shape(s). Bit design parameters 312 may also comprise at least one of cutting element count, cutting element height, cutting element geometrical shape, cutting element spacing, cutting element orientation, cone axis offset, cutting element material, cutting element location, cone diameter profile, and bit diameter. The cutting element and roller cone geometry can be converted to coordinates and used as input for the invention. Preferred methods for bit design parameter inputs include the use of 3-dimensional CAD solid or surface models to facilitate geometric input.

Cutting element/earth formation interaction data 314 used as input may include data that characterize the interactions between a selected earth formation (which may have, but need not necessarily have, known mechanical properties) and an individual cutting element having known geometry.

Bottomhole geometry data 316 used as input may include geometrical information regarding the bottomhole surface of an earth formation, such as the bottomhole shape. As previously explained, the bottomhole geometry may be planar at the beginning of a simulation, but this is not a limitation on embodiments of the invention. The bottomhole geometry can be represented as a set of axial (depth) coordinates positioned within a defined coordinate system, such as in a Cartesian coordinate system. In accordance with one embodiment of the invention, the bottomhole surface may be represented as a mesh shape having a suitable mesh size, e.g. 1 millimeter.

As shown in FIG. 3A, once the input data 310–316 are entered or otherwise made available, calculations in the main simulation loop 320 can be carried out. In the main simulation loop 320, drilling simulation is performed by incrementally "rotating" the bit through an incremental angle and determining an approximate vertical (axial) displacement of the bit corresponding to the incremental bit rotation. Once the approximate vertical displacement is obtained, the lateral forces on the cutting elements may be calculated and used to determine the current rotation speed of the cones. Finally, the bottomhole geometry is updated by removing the deformed earth formation resulting from the incremental drilling calculated in the simulation loop 320. A more detailed description of the elements in the simulation loop 320 is as follows.

The first step in the simulation loop 320 in FIG. 3A, involves "rotating" the roller cone bit (numerically) by a selected incremental angle amount, $\Delta\theta_{bit,i}$, 322. In one example embodiment, the selected incremental angle is 3 degrees. It should be understood that any incremental angle may be chosen for the convenience of a system designer and should not limit the invention. The incremental rotation of the bit results in an incremental rotation of each cone on the bit, $\Delta\theta_{cone,i}$. In one example, the rotational speed of the cones is determined by the rotational speed of the bit, $\Delta\theta_{bit,i}$, and the effective radius of the "drive row" of the cones. The effective radius is generally related to the radial extent of the cutting elements that extend axially the farthest from the axis of rotation of the cones; these cutting elements are located on a so-called "drive row." Thus, the rotational speed of the cones can be defined or calculated based on the known rotational speed of the bit and the defined geometry of the cones provided as input (e.g., the cone diameter profile and cone axial offset). Then, the incremental rotation of the cones, $\Delta\theta_{cone,i}$, may be calculated based on incremental rotation of the bit, $\Delta\theta_{bit,i}$, and the calculated rotational speed of the cones 324.

Once the incremental rotation of each cone $\Delta\theta_{cone,i}$ is calculated, the new locations of the cutting elements, $p_{\Theta,i}$, are computed based on bit rotation, cone rotation, and the immediately previous locations of the cutting elements $p_{i-1}$. The new locations of the cutting elements 326 can be determined by any method for geometric calculations known in the art. In addition to new locations of the cutting elements, vertical displacements of the bit resulting from the incremental rotations of the bit may be, in one embodiment, iteratively computed in a vertical force equilibrium loop 330.

In the vertical force equilibrium loop 330, the bit is "moved" (axially) downward (numerically) a selected initial incremental distance $\Delta d_i$ and new cutting element locations $p_i$ are calculated, as shown at 332 in FIG. 3A. In this example, the selected initial incremental distance is 2 mm. It should be understood that the initial incremental distance selected is a matter of convenience for the system designer and is not intended to limit the invention. Then, the cutting element interference with the existing bottomhole geometry is determined, at 334. This includes determining the depth of penetration of each cutting element into the earth formation and a corresponding interference projection area. The depth of penetration is defined as the distance from the formation surface a cutting element penetrates into an earth formation. The depth of penetration can range from zero (no penetration) to the full height of the cutting element (full penetration). The interference projection area is the fractional amount of surface area of the cutting element which actually contacts the earth formation. Upon first contact of a cutting element with the earth formation, such as when the formation presents a smooth, planar surface to the cutting element, the interference projection area is substantially equal to the total contact surface area corresponding to the depth of penetration of the cutting element into the formation.

However, upon subsequent contact of cutting elements with the earth formation during simulated drilling, each cutting element may have subsequent contact area less than the total available contact area on a cutting element. This less than full area contact results from the formation surface having "craters" (deformation pockets) made by previous contact with a cutting element. Fractional area contact on any of the cutting elements reduces the interference and axial force acting on the cutting element, which can be accounted for in the simulation calculations.

Once the cutting element/earth formation interaction is determined for each cutting element, the vertical force, $f_{V,I}$, applied to each cutting element may be calculated based on the calculated penetration depth, the projection area, and the cutting element/earth formation interaction data 312. This is shown at 336 in FIG. 3B. Thus, the axial force acting on each cutting element is related to the cutting element penetration depth and the cutting element interference projection area. One of ordinary skill in the art would appreciate that a drilling simulation may be performed with a constant RPM or a constant WOB. In accordance with one embodiment of the invention, the simulation is driven by a constant WOB. In this embodiment, a simplifying assumption used in the simulation is that the WOB is equal to the summation of vertical forces acting on each cutting element. Therefore, the vertical forces, $f_{V,i}$, on the cutting elements are summed to obtain a total vertical force $F_{V,i}$ on the bit, which is then compared with the selected axial force applied to the bit (the WOB) for the simulation, as shown at 338. If the total vertical force $F_{V,i}$ is greater than the WOB, the initial incremental distance $\Delta d_i$ applied to the bit is larger than the incremental axial distance that would result from the selected WOB. If this is the case, the bit is moved up a fractional incremental distance (i.e., the incremental axial movement of the bit is reduced), and the calculations in the vertical force equilibrium loop 330 are repeated for the resulting incremental distance.

If the total vertical force $F_{V,i}$ on the cutting elements is less than the WOB, the resulting incremental distance $\Delta d_i$ applied to the bit is smaller than the incremental axial distance that would result from the selected WOB. In this case, the bit is moved further down, and the calculations in the vertical force equilibrium loop 330 are repeated. The vertical force equilibrium loop 330 calculations iteratively continue until a proper axial displacement for the bit is obtained that results in a total vertical force on the cutting elements substantially equal to the selected WOB, or within a selected error range.

Once proper axial displacement, $\Delta d_i$, of the bit is obtained, the lateral movement of the cutting elements may be calculated based on the previous, $p_{i-1}$, and current, $p_i$, cutting element locations, as shown at 340. Then, the lateral force, $f_{L,i}$, acting on the cutting elements is calculated based on the lateral movement of the cutting elements and cutting element/earth formation interaction data, as shown at 342. Next, the cone rotation speed is calculated based on the forces on the cutting elements and the moment of inertia of the cones, as shown at 344.

Finally, the bottomhole pattern is updated, at 346, by calculating the interference between the previous bottomhole pattern and the cutting elements during the current incremental drilling step, and based on cutting element/earth formation interaction, "removing" the formation as a result of the incremental rotation of the selected bit with the selected WOB. In this example, the interference can be represented by a coordinate mesh or grid having 1 mm grid blocks.

This incremental simulation loop 320 can then be repeated by applying a subsequent incremental rotation to the bit 322 and repeating the calculations in the incremental simulation loop 320 to obtain an updated bottomhole geometry. Using the total bit revolutions to be simulated as the termination command, for example, the incremental displacement of the bit and subsequent calculations of the simulation loop 320 will be repeated until the selected total number of bit revolutions to be simulated is reached. Repeating the simulation loop 320 as described above will result in simulating the performance of a roller cone drill bit drilling earth formations with continuous updates of the bottomhole pattern drilled, simulating the actual drilling of the bit in a selected earth formation. Upon completion of a selected number of operations of the simulation loops 320, results of the simulation can be programmed to provide output information at 348 characterizing the performance of the selected drill bit during the simulated drilling, as shown in FIG. 3B. It should be understood that the simulation can be stopped using any other suitable termination indicator, such as a selected axial displacement.

Referring back to the embodiment of the invention shown in FIGS. 3A and 3B, drilling parameters 310, bit design parameters 312, and bottomhole parameters 316 required as input for the simulation loop of the invention are distinctly defined parameters that can be selected in a relatively straight forward manner. On the other hand, cutting element/earth formation interaction data 314 are not defined by a clear set of parameters, but can be obtained in a number of different ways.

In one embodiment of the invention, cutting element/earth formation interaction data 314 may comprise a library of data obtained from actual tests performed using selected cutting elements, each having known geometry, on selected earth formations. In this embodiment, the tests include impressing a cutting element having a known geometry on the selected earth formation with a selected force. The selected earth formation may have known mechanical properties, but it is not essential that the mechanical properties be known. Then, the resulting grooves formed in the formation as a result of the interaction between the inserts and the formation are analyzed. These tests can be performed for different cutting elements, different earth formations, and different applied forces, and the results analyzed and stored in a library for use by a simulation method of the invention. These tests can provide good representation of the interactions between cutting elements and earth formations under selected conditions.

In one embodiment, these tests may be repeated for each selected cutting element in the same earth formation under different applied loads, until a sufficient number of tests are performed to characterize the relationship between interference depth and impact force applied to the cutting element. Tests are then performed for other selected cutting elements and/or earth formations to create a library of crater shapes and sizes and information regarding interference depth/impact force for different types of bits in selected earth formations.

Alternatively, single insert tests, such as those described in U.S. Pat. No. 6,516,293, may be used in simulations to predict the expected deformation/fracture crater produced in a selected earth formation by a selected cutting element under specified drilling conditions.

In another embodiment of the invention, techniques such as Finite Element Analysis, Finite Difference Analysis, and Boundary Element Analysis may be used to determine the cutting element/earth formation interaction. For example, the mechanical properties of an earth formation may be measured, estimated, interpolated, or otherwise determined, and the response of the earth formation to cutting element interaction may be calculated using Finite Element Analysis.

After the simulation phase is complete, the data collected from the simulation may be used to analyze bending moment encountered by cutting elements, cones, and/or bits (Step 352 in FIG. 3B). By analyzing the bending moment induced on the roller cone or drill bit, the designer can optimize the design of the drill bit by determining the effects of the moment on the bit and identifying locations of potential breakage.

Figure 4:
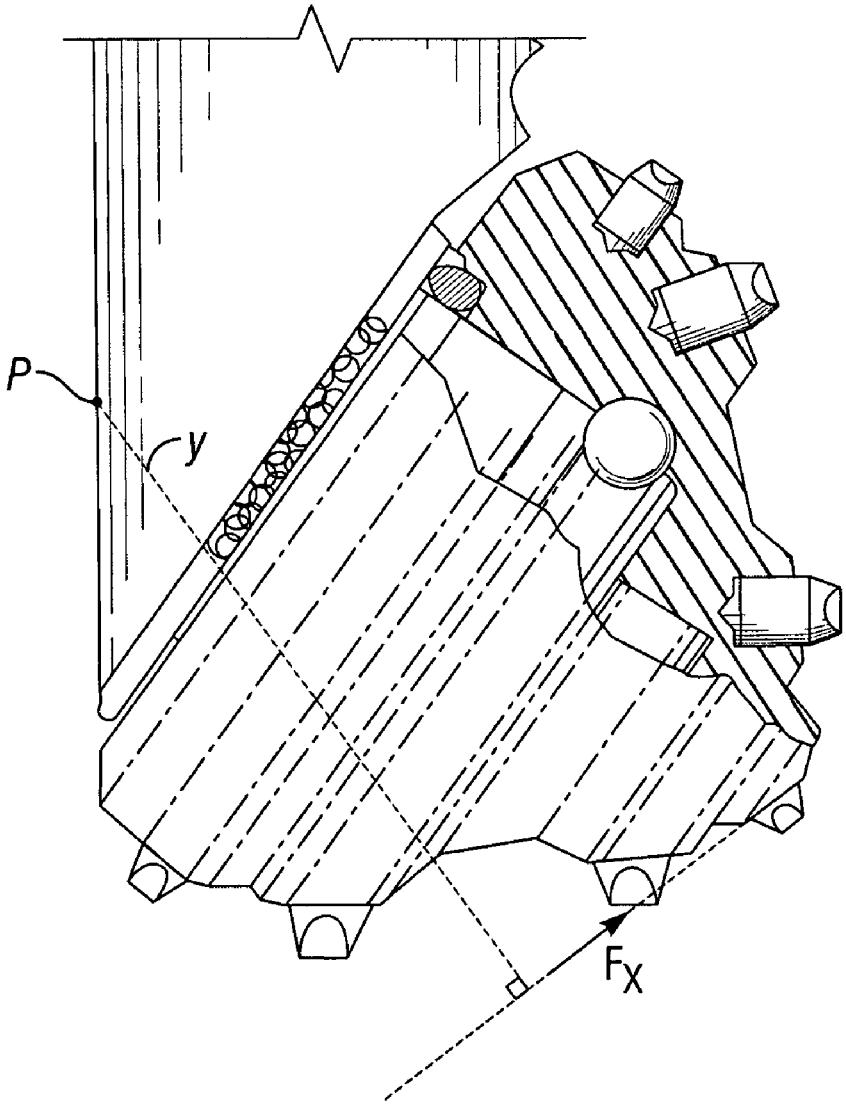
FIG. 4 shows a drill bit.

The bending moment, as used herein, is a function of the force acting on a drill bit and the distance between a pivot point and the location of the force exerting on the bit. The bending moment may be calculated relative to any location (pivot point) on the drill bit. As shown in FIG. 4, a bending moment may be determined by multiplying the applied forces Fx acting on the drill bit by the "perpendicular distance" y between the location of the applied force Fx and the pivot point P, i.e., point about which the bending moment is measured. The "perpendicular distance" y corresponds to the distance from the pivot point P to a line drawn through the location of the force Fx acting on the bit and along the direction of the force (see FIG. 4). For drill bit designs, the bending moments of interest are those leading to breakages. Therefore, the bending moments of interest are often related to the narrow regions/points on the bit, such as journal attachment point to a leg, seal gland on a cone, etc.

Those of ordinary skill in the art will recognize that the bending moment may be calculated in a number of ways. In one embodiment, an expression for the bending moment produced by the force (Fx) with respect to a neutral axis through the pivot point (P) is simply the sum of the force times the perpendicular distance (y) to the neutral axis, or:

$$M = \sum_{y>0,y\max} F_x \blacklozenge y \qquad \text{Equation 1}$$

The force F, may alternatively be expressed as:

$$Fx=\sigma dA \qquad \text{Equation 2}$$

where the force acting on any cutting element (dA) is the product of axial stress at that point and the amount of area (dA). This simply comes from the definition of axial stress=Force/Area.

Thus, the expression for the bending moment may be written as follows:

$$M = \sum_{y>0,y\max} \sigma dA * y \qquad \text{Equation 3}$$

During a drilling operation, forces are typically exerted on the cutting elements. Thus, bending moments exerting on these cutting elements may be individually calculated in the manner described above, or in some other fashion, and then summed to give a total bending moment acting on a cone. Similarly, bending moments acting on a drill bit may be calculated by summing all bending moments acting on individual cones. The maximum, median, and average moment encountered by a cutting element in a given row, and the maximum, median, and average moment encountered by each cone may be displayed.

In accordance with some embodiments of the invention, the bending moment encountered by the cutting elements may be displayed in tabular form, as shown in FIG. 5. Alternatively, the bending moment may be displayed graphically, for example, by a plot showing a location of a bending moment.

The drill bit may be analyzed to determine the amplitude of bending moments with respect to various locations on the bit. The designer can also determine the bending moment at a selected location on the drill bit. Additionally, the designer may implement an amplitude control, that is, pre-select limits of allowable bending moments encountered by different areas of the drill bit. By pre-selecting limits of allowable bending moments, the design of the drill bit may be optimized. The optimized design may be configured to reduce the risk of deformation of the bit or leg breakage.

The drill bit may also be analyzed to determine the frequency of bending moments during the drilling operation. The designer may determine the frequency at which a cutting element, cone, or drill bit encounters bending moment. The designer may also determine the frequency of a given bending moment amplitude encountered by different areas of the drill bit. Additionally, the designer may implement a frequency control, that is, pre-select limits of allowable frequency of bending moments encountered by different areas of the drill bit. By pre-selecting limits of allowable frequency of bending moments, the design of the drill bit may be optimized. The optimized design may be configured to reduce the risk of fatigue or deformation of the bit, or leg breakage.

In accordance with some embodiments of the invention, multiple drill bit designs are simulated and analyzed. For example, the amplitude, frequency, and location of the bending moments encountered by the cutting elements, cones, and/or drill bit for each design are determined and analyzed. A relative comparison of bending moments among different designs is then performed to select a bending moment optimized design. In some embodiments, the design with the smallest bending moments is preferred. In other embodiments, the design with bending moments within a preferred selected limit of, for example, frequency or amplitude, is preferred.

In one embodiment, the bending moments of interest are the bending moments acting on the backface of the leg. Referring back to FIG. 4, a bending moment of interest is a bending moment acting at, for example, point P. In one embodiment, the sum of all bending moments acting on the backface of the leg are analyzed. In some embodiments, the design of the drill bit is optimized by minimizing the bending moments acting on the backface of the leg. In other embodiments, a drill bit design is optimized when pre-selected limits set for bending moments, i.e. amplitude and frequency limits, acting on the backface of the leg are met.

Thus, the above methodology provides a method for simulating a drill bit drilling a formation. Some embodiments of the invention include graphically displaying the simulation of the drill bit, and other embodiments relate to methods for designing drill bits having improved bending moment characteristics. In one embodiment, a method of the invention includes selecting an initial bit design, calculating the performance of the initial bit design, then adjusting one or more design parameters and repeating the performance calculations until an optimal set of bit design parameters is obtained. In another embodiment, this method can be used to analyze relationships between bit design parameters and bending moment performance of a bit. In another embodiment, the method can be used to design roller cone bits having enhanced drilling characteristics. For example, the method can be used to analyze row spacing optimization, intra-insert spacing optimization, tracking, and forces acting on rows and cutting elements.

Output information that may be considered in identifying bit designs possessing enhanced drilling characteristics includes bending moment. This output information may be in the form of visual representation parameters calculated for the visual representation of selected aspects of drilling performance for each bit design, or the relationship between values of a bit parameter and the drilling performance of a bit. Alternatively, other visual representation parameters may be provided as output as determined by the operator or system designer. Additionally, the visual representation of drilling may be in the form of a visual display on a computer screen. It should be understood that the invention is not limited to these types of visual representation, or the type of display. The means used for visually displaying aspects of simulated drilling is a matter of convenience for the system designer, and is not intended to limit the invention.

Figure 6:
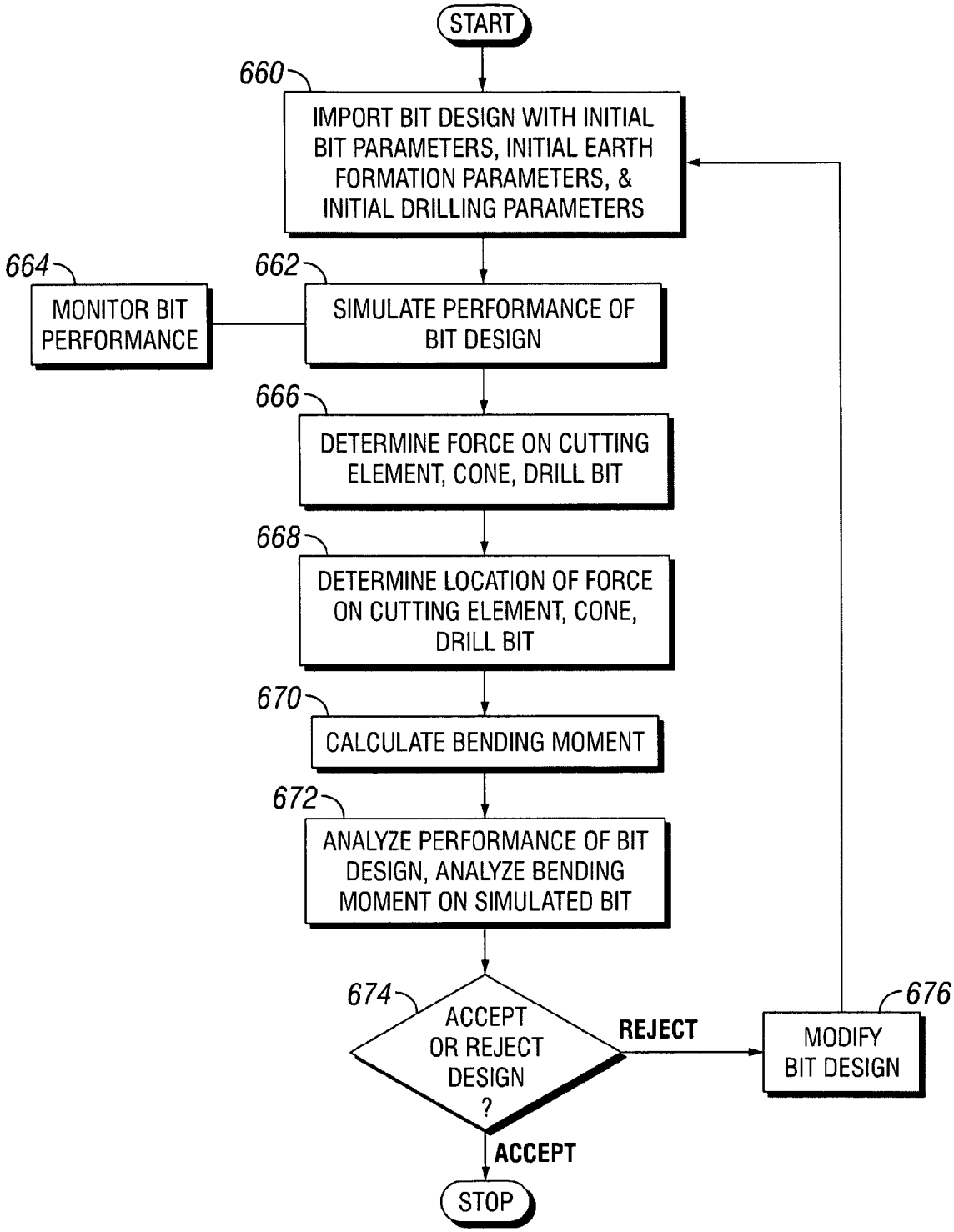
FIG. 6 shows a flowchart of an embodiment of the invention.

Thus, in one embodiment of the invention, as shown in FIG. 6, a designer imports a bit design 660 into a computer containing the simulation software in accordance with an embodiment of the present invention. The performance of this bit design is then simulated 662. During the simulation, the bending moment encountered by the cutting elements and the cones may be monitored by the designer 664. At the end of the simulation step, the force acting on the cutting element, cone, and/or drill bit is determined 666. The location of the force is also determined 668 from the simulation. Using the force and location of the force, any bending moment with respect to any potential breakage point may be calculated 670 as described above. The performance of the bit, specifically, the bending moment encountered by the simulated cutting elements, cones, and/or drill bit is analyzed 672.

After analyzing the performance of the bit, specifically, the bending moment of the cutting elements and the cones, the design may be accepted or rejected 668. In one embodiment of the invention, the designer may determine a "stop" point for the design. That is, the individual designer makes a determination as to when a bit is optimized for a given set of conditions. In other embodiments, however, the process may be automated to reach a pre-selected end condition. If the bit is rejected, the bit may be redesigned. The bit design may be modified 676, for example, by modifying the initial bit parameters. For example, the orientation, spacing, number, material, location of the cutting elements and/or rows may be modified. Those having skill in the art will appreciate that bit designs may be changed in a variety of ways, and no limitation on the scope of the present invention is intended by listing specific changes. If the design is accepted, the design process is halted.

As described above, the invention can be used to analyze the bending moment encountered by the cutting elements, roller cones, and drill bits, or as a design tool to simulate and optimize the performance of roller cone bits drilling earth formations. The invention enables the analysis of drilling characteristics of proposed bit designs prior to their manufacturing, thus, minimizing the expense of trial and error designs of bit configurations. The invention enables the analysis of the effects of adjusting drilling parameters on the drilling performance of a selected bit design. Further, the invention permits studying the effect of bit design parameter changes on the drilling characteristics of a bit and can be used to identify a bit design which exhibits desired drilling characteristics. Furthermore, use of the invention leads to more efficient designing and use of bits having enhanced performance characteristics and enhanced drilling performance of selected bits.

While the invention has been described with respect to a limited number of embodiments, those skilled in the art, having benefit of this disclosure, will appreciate that other embodiments can be devised which do not depart from the scope of the invention as disclosed herein. For example, while embodiments of the invention are illustrated with a roller cone drill bit, those of ordinary skill in the art would appreciate that embodiments of the invention are not limited to roller cone bits. Accordingly, the scope of the invention should be limited only by the attached claims.

What is claimed is:

1. A method for designing a drill bit, the method comprising:

selecting bit design parameters;

selecting parameters of an earth formation;

selecting drilling parameters;

simulating drilling the earth formation;

calculating a bending moment acting on the drill bit;

converting said bending moment into a visual representation;

varying at least one of the bit design parameters and repeating the simulating and the calculating until the bending moment meets a selected criterion, and graphical displaying the visual representation.

2. The method of claim 1, wherein the bit design parameters comprise at least one of cutting element count, cutting element height, cutting element geometrical shape, cutting element spacing, cutting element orientation, cone axis offset, cutting element material, cutting element location, cone diameter profile, and bit diameter.

3. The method of claim 1, further comprising determining force acting on at least one of a cutting element, a cone, and a drill bit.

4. The method of claim 3, further comprising determining location of the force.

5. The method of claim 4, further comprising determining the frequency of bending moments.

6. The method of claim 5, further comprising limiting the frequency of bending moments.

7. The method of claim 1, further comprising determining bending moment amplitudes.

8. The method of claim 7, further comprising limiting the amplitudes of the bending moments.

9. The method of claim 7, further comprising determining the frequency of a selected bending moment amplitude.

10. The method of claim 9, further comprising limiting the frequency of a selected bending moment amplitude.

11. The method of claim 1, wherein the parameters of the earth formation comprise a hardness of the formation.

12. The method of claim 1, wherein said bit design parameters form part of a computer aided design file.

13. The method of claim 1, wherein said drilling parameters comprise weight on bit.

14. The method of claim 1, wherein said drilling parameters comprise rotational speed of a bit.

15. The method of claim 1, wherein the simulating incrementally rotating said drill bit is repeated until an optimized roller cone drill bit design is achieved.

16. The method of claim 1, wherein the visual representation is in tabular form.

17. The method of claim 1, wherein the visual representation is a graphical display of the drill bit showing said calculated bending moments.

18. A drill bit designed by the method of claim 1.

* * * * *